United States Patent [19]

Lindström

[11] 4,280,668

[45] Jul. 28, 1981

[54] THREAD-STORAGE AND DELIVERY DEVICE FOR TEXTILE MACHINES

[75] Inventor: Fred B. Lindström, Junkoping, Sweden

[73] Assignee: Aktiebolaget IRO, Ulricehamn, Sweden

[21] Appl. No.: 81,583

[22] Filed: Oct. 3, 1979

[30] Foreign Application Priority Data

Oct. 5, 1978 [DE] Fed. Rep. of Germany ..... 2843548

[51] Int. Cl.[3] ..... B65H 51/20

[52] U.S. Cl. ..... 242/47.12

[58] Field of Search ..... 242/47.12, 47.01, 47.04, 242/47.05, 47.07, 47.08, 47.09, 47.1, 47.11, 47.13, 82, 83, 47, 53; 139/452; 66/132 R

[56] References Cited

U.S. PATENT DOCUMENTS

| | | | |
|---|---|---|---|
| 3,776,480 | 12/1973 | Lawson | 242/47.12 X |
| 3,796,384 | 3/1974 | Rosen | 242/47.12 |
| 3,944,156 | 3/1976 | Jacobsson et al. | 242/47.12 |
| 4,090,677 | 5/1978 | Savio et al. | 242/47.12 X |
| 4,092,006 | 5/1978 | Jacobsson | 242/47.12 X |
| 4,165,049 | 8/1979 | Pejchal et al. | 242/47.01 |

FOREIGN PATENT DOCUMENTS 2352521 4/1975 Fed. Rep. of Germany .

*Primary Examiner*—Stanley N. Gilreath
*Attorney, Agent, or Firm*—Blanchard, Flynn, Thiel, Boutell & Tanis

[57] ABSTRACT

A thread-storage and delivery device having a rotation shaft and a drum coaxial with and rotatably supported thereon. A feed mechanism rotates with the shaft for tangentially winding a thread onto the periphery of the drum. An advancing member is positively coupled to the drum for advancing thread windings thereon axially toward the withdrawal rim. The advancing member is rotatably supported on the shaft about an axis which is inclined at a small angle relative to the shaft axis so that the advancing member executes an axial wobbling movement as the shaft rotates. The advancing member has an outer portion projecting beyond the periphery of the drum for engaging the thread windings. Coacting braking and counterbraking elements cooperate directly between a stationary annular flange and the outer portion of the advancing member for maintaining the drum stationary. The braking and counterbraking elements are disposed in meshing engagement during rotation of the feed mechanism at only a single point which is offset circumferentially of the drum relative to the discharge end of the feed mechanism, which point rotatably migrates around the drum in correspondence with rotation of the feed mechanism.

17 Claims, 9 Drawing Figures

FIG. 4
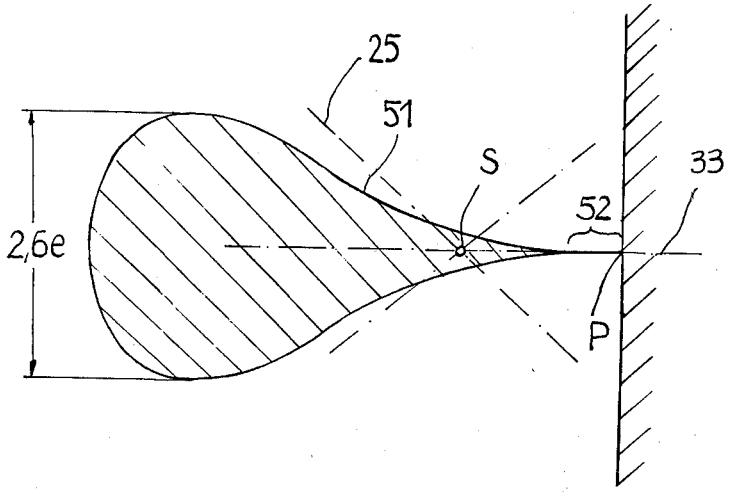
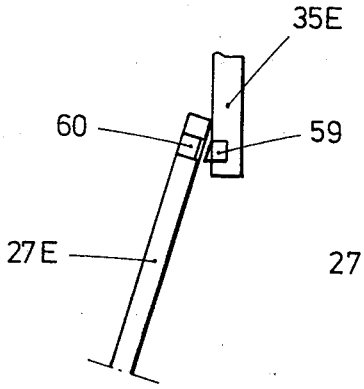
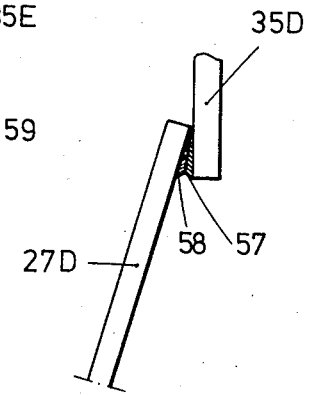
FIG. 8 FIG. 7

THREAD-STORAGE AND DELIVERY DEVICE FOR TEXTILE MACHINES

FIELD OF THE INVENTION

This invention relates to a thread-storage and delivery device for a textile machine, which device incorporates improved structure for holding the storage drum stationary.

BACKGROUND OF THE INVENTION

In thread-storage and supply devices, in which the thread is tangentially wound upon the storage drum by means of the feed element which is set in rotation and is thereafter withdrawn at the top, the storage drum itself must not execute any rotation, since the thread would otherwise be undesirably twisted. The rotating feed element and the unwinding thread, however, make it impossible to grip and stationarily hold the storage drum, which itself is mounted on the rotating shaft, from any external position, i.e, from the base body. Hence, other precautions are known which attempt to hold the stoarge drum stationary. These, however, all involve a considerable technical outlay.

A thread-storage and delivery device is known from German OS No. 23 52 521, in which the drum holding mechanism consists of a permanent magnet which is arranged in the storage drum and a permanent magnet which is fastened stationarily in the machine frame. This magnet pair act on one another for holding the storage drum stationary on the shaft which supports it. However, for thick threads, a relatively large air gap must be provided between the magnets, which thus requires strong and heavy magnets. These undesirably increase not only the weight of the entire device, but also make access to the drum jacket more difficult since, for example, several magnet pairs are distributed over the periphery. During adjusting of the device or during a breakdown in operation, good accessibility to the drum jacket is especially of importance. Also, the permanent magnets can never hold the drum totally stationary. Rather, rotary oscillations of the drum result in undesired tension variations in the unwinding thread. It is furthermore disadvantageous in this known device that the wobbling disk is indirectly held against rotation through a toothed engagement with the drum jacket. Teeth of the wobbling disk loosely engage within windows of the drum jacket, wherein each tooth—in relationship to its window—carries out an elliptical movement, which during the engagement leads to a characteristic motion component which lies in the direction of rotation. Thus the wobbling disk is exposed to a constant oscillating movement about the drum axis, which movement causes vibrations in the device and friction loads on the thread winding which are being wound around the drum.

In a device which is known from German OS No. 22 20 207 (and corresponding portions of U.S. Pat. No. 3,776,400), the advance of the thread windings is not done by a wobbling disk, but by rods which are operated by a complicated mechanism. As a holding mechanism there is provided coaxial toothed rims at the upper edge of the storage drum core and at the lower edge of the drive housing, and an angularly positioned toothed disk is inserted into the free space provided therebetween, which toothed disk is rotatably supported by a bearing on a sloped hub provided on the through-going shaft of the device. The toothed disk simultaneously wobbles on both toothed rims, from which results difficult engagement and rolling relationships, which during operation lead to vibrations. The device is complicated and lengthy in structure.

The basic purpose of this invention is to produce a thread-storage and delivery device of the above-mentioned type, which is characterized by a light weight and a short structural length, and which does not require any additional devices for holding the storage drum stationary in a soundless and vibrationless manner, this being accomplished by using the same parts which are required for the proper functioning of the device with simple additional provisions, thereby permitting a gentle thread advance.

The above purpose is attained in a device of the above-mentioned type through the characteristics defined in the attached claims.

In this invention, the advancing member required for the thread advance is additionally utilized as an active part for holding the storage drum stationary. Unlike the conventional device, the storage drum no longer holds the advancing member, but same is continuously coupled with the base member (i.e., specifically to an annular flange fixed to the base member, by braking and counterbraking elements) at a point which is offset relative to the feed element and is held by the base member. The storage drum is then supported against rotation by the advancing member. The thread feed, the winding up and unwinding of the thread, remains unaffected. Additional construction elements, as they are needed in the conventional device, are not needed. The device is thus compact and of light weight, and is distinguished by a simple structure and a short structural length. Unhindered access to the thread storage on the drum jacket is possible from all sides. Of particular importance is that the engagement between the advancing member and the annular flange occurs almost totally without any sound and without vibration, and that relative oscillating movements, which are damaging for the transport of the thread windings and during engagement, between the storage drum and the advancing member, do not occur. The given geometrical conditions result in an ideal rolling along of the outer section of the advancing member along the annular flange and in exact engagement conditions. Furthermore, the advantage is obtained that the braking elements and the counterbraking elements lie on these two cooperating parts on equal diameters, in relationship to the respective axis of rotation of each part. This makes the manufacture easier. Furthermore, a very advantageous and gentle movement of the thread during the wobbling movement of the advancing member is achieved, during which the outer section of the advancing member acts onto the thread windings in the advancing direction, since the outer section linearly moves the thread windings so that damaging friction does not occur between the outer section and the thread windings. This thus does not affect or influence the thread-unwinding tension which is to be kept constant. The gentle handling of the thread is thus an important aspect of the device.

A device for braking a fiber cable which is linearly blown at a high speed and for storing it without any speed in a can is known from BE Pat. No. 867,061, in which each winding of the fiber cable is moved downwardly by a spider positioned at an inclination with respect to the shaft of the device and thus wobbles during its rotation, which spider is provided on the periphery of a rod drum which is hindered against rotation and is stored in the can. The spider engages, with its radially outwardly projecting spoke ends, an internal tooth system of a ring which is coaxially arranged outside of the device and is prevented by said engagement against corotation therewith. Furthermore, the rods of the rod drum engage between the spokes, so that these are also held stationary. This conventional device cannot be compared with a thread-delivery and storage device of the type disclosed in this invention wherein a thread is intermittently unwound from a spool of a thread-delivery and storage device, is then wound up to form a thread storage on the drum surface, and is again unwound overhead from said drum over a specially constructed drum rim with a constant thread tension, whereby the rotatable parts are driven only when the formed thread storage is too small. Rather, the aforesaid conventional device continuously works with a quickly accumulated fiber cable and stores it in windings in a can, whereby same, if desired during an axial impressing on a coaxial cutting rim, is cut into individual fiber cable pieces. From the kinematics of this conventional device, it is necessary only that it stop the speed of the fiber cable. A vibrationless running of the wobbling disk, the exclusion of oscillating movements of the disk and of the braking surface, and free access to the braking surface are not desired. The spokes of the spider engage between the teeth of the stationary rim, while the rods of the rod drum engage between the spokes. The required clearance or play, and the line-shaped contact zones between the engaging parts, results in rough engaging and running conditions, which conditions are intolerable in a thread-storage and delivery device of the type according to the present invention.

In a preferred exemplary embodiment of the present inventive device, the braking and counterbraking elements achieve a positive coupling between the base flange and the advancing member. With this given form, locking occurs between the storage drum and the advancing member during each rotation of the storage drum, and oscillating rotation of the storage drum is reliably prevented.

In a further advantageous embodiment of an inventive device the "effective" rim area of the outer section of the advancing member rolls along on the underside of the flange, and projections are progressively inserted into depressions, whereby a uniform and quiet running can be achieved.

In a further advantageous embodiment the advancing member constantly rolls along with its outer section on the flange, and the use of a friction coating is sufficient for a reliable securing of the storage drum against rotation. Special vibration reduction and quiet running, with a constantly effective self-cleaning effect, result from this construction.

Measures for achieving quiet running and vibration reduction can be incorporated into the embodiment of the invention. The braking and counterbraking elements may consist of an elastic plastic which is solid enough to satisfactorily absorb the occurring forces, and which automatically compensates for possible deformations. Alternatively, it is possible to utilize a nonelastic plastic, preferably polyurethane such as Contilan (registered trademark), for the manufacture of the braking and counterbraking elements, if these receive a special form or shape. Such elements of a relatively nonelastic plastic then become elastic in themselves, if they are provided for example with through-holes or recesses. In such a configuration it is also possible to use nylon, which can be simply formed, for example by being pressed or injection molded.

BRIEF DESCRIPTION OF THE DRAWINGS

Exemplary embodiments of the subject matter of the application will be discussed in more detail hereinafter in connection with the drawings.

FIGS. 3 and 4 are schematic illustrations concerning the geometric relationships during the wobbling movement of the advancing member of FIG. 1, but with the angle of inclination of the advancing member being exaggerated for a better understanding.

FIG. 7 illustrates a detail from a further embodiment.

FIG. 8 illustrates a detail from a still further embodiment.

DETAILED DESCRIPTION

Figure 1:
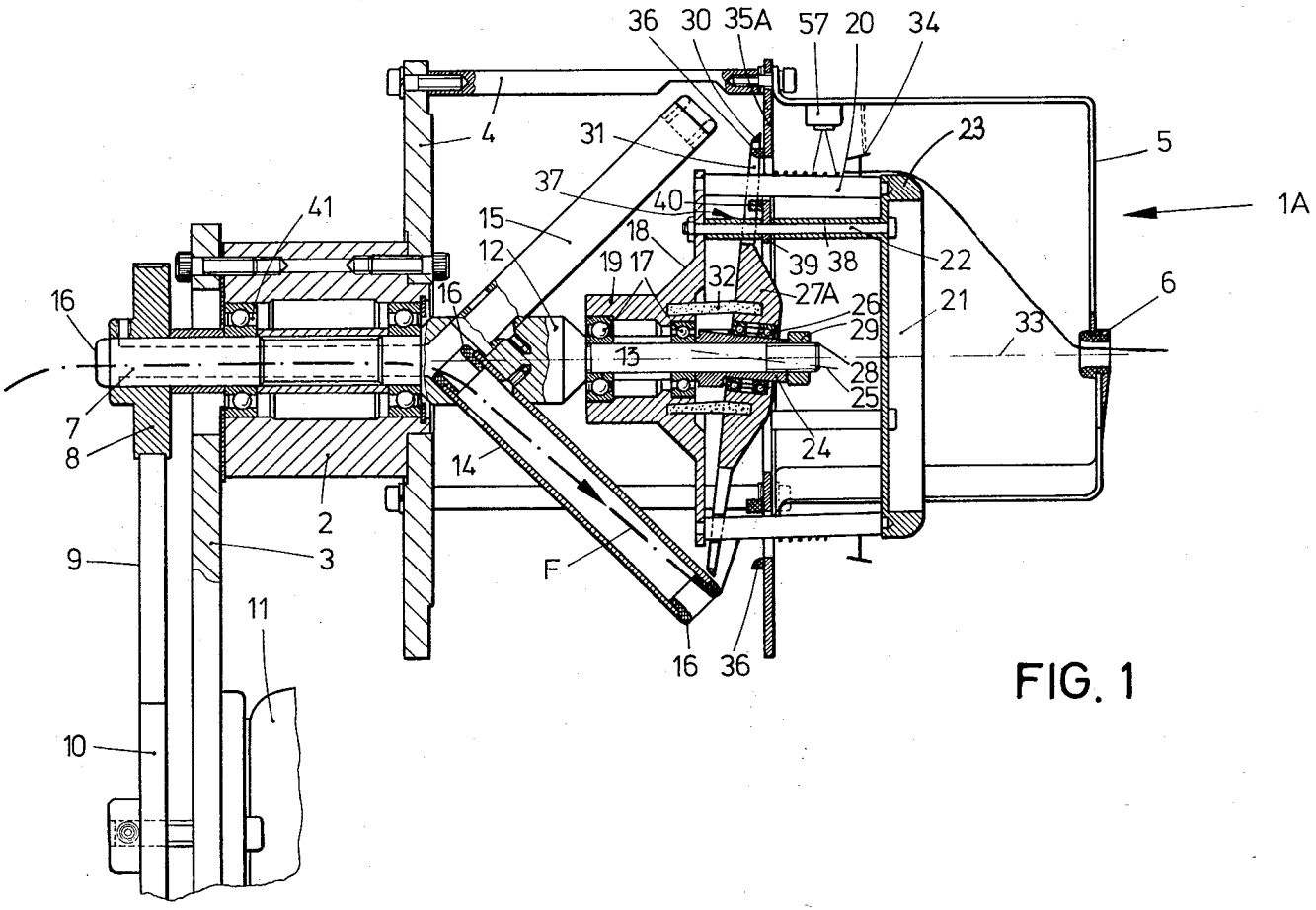
FIG. 1 is a longitudinal cross-sectional view of a first embodiment of a thread-storage and delivery device.

A first embodiment of a thread-storage and delivery device 1A, as shown in FIG. 1, includes a stationary frame or body formed by a sleevelike base member 2 which is connected to a base support plate 3 and which carries a base shell 4 together with a support structure 5. The support structure 5 carries a thread withdrawal eye 6 and a photocell 57. A drive shaft 7 is rotatably supported on the base member by bearings 41, and is driven by a motor 11 through a first belt pulley 8, a drive belt 9 and a second belt pulley 10. The first section of the drive shaft 7 is hollow, then merges into a thickened portion 12, and terminates in a smaller journal 13. A radially and obliquely inclined, outwardly pointing tubular member 14 is mounted in the thickened portion 12 and defines the thread feed member. A dummy tube 15 is disposed diametrically opposite the tubular member 14 for reasons of balance. Smooth ceramic thread eyes 16 are inserted into the shaft 7 and into the feed member 14.

A storage drum 18 is rotatably supported on the journal 13 by means of bearings 17. The storage drum consists of a base plate 19, a rod cage 20 and a cover plate 21, the cover plate 21 being rigidly connected to the base plate 19 by means of spacing bolts 22 and the rods of the rod cage 20.

The thread F is supplied to the device from the externally accessible end of the shaft 7, which thread extends outwardly through the feed member 14 and from there is wound around the jacket of the storage drum 18, from which it can be unwound again off the top over the drum rim 23 and through the thread eye 6 for feeding to the textile machine. The amount or number of thread windings on the drum is monitored by the photocell 57 which switches on the motor 11 as soon as a minimum amount is reached. After a certain amount of thread has again been built up, the photocell 57 again turns off the motor 11.

A sleeve 24 is mounted nonrotatably on the free end of the journal 13. The outer periphery of the sleeve 24 has a cylindrical bearing seat for a bearing assembly 26 which defines an axis of rotation 25 which is obliquely inclined at a small angle relative to the axis of rotation 33 of the shaft 7. A disk-shaped advancing member 27A is rotatably supported on said bearing assembly 26. The sleeve 24 is fixedly secured in position on the journal 13 by means of a tension nut 29 which is screwed onto an external thread 28 on the journal 13. The inclination of the axis 25 is about 6°, for example.

The advancing member 27A has an outer annular rim 30 from which slots 31, which are radially aligned with the axis 25, extend inwardly toward the center of the advancing member 27A. An elastic sleeve 32, which protects the bearing areas against contamination from outside, is inserted between the advancing member 27A and the hub portion 19 of the storage drum 18.

A conventional thread braking ring 34 is connected to the support structure 5, which ring grips the outside of the drum jacket and imparts to the unwinding thread an advantageously low and constant unwinding tension.

An annular flange 35A, which lies perpendicularly with respect to the shaft axis 33 is fixedly screwed to the stationary base member 4. The annular flange 35A has its inner peripheral edge spaced radially outwardly from the drum jacket. Flange 35A is also axially spaced from the discharge end of the feed element 14. Near and uniformly distributed around the circumference of the inner peripheral edge of the flange 35A, there are secured axially-directed pegs or toothlike projections 36, advantageously of a material which is elastic at least in the axial direction. These pegs or projections function as braking elements and engage or mesh with at least one of the radial slots 31 (which function as counterbraking elements) in the advancing member 27A on the side of the device which is diametrically opposite the feed element 14.

A circular support 39 is secured inside of the storage drum 18 on the spacing bolts 22 with the help of spacing sleeves 37 and 38. The support 39 has similar axial projections 40 which engage the radial slots 31, which projections are also advantageously of the same elastic material. The projections 40 are also uniformly distributed around the circumference of the support.

The device of FIG. 1 operates as follows

The arriving thread F is wound tangentially upon the drum jacket 18 by the feed element 14 to form a thread storage. Since the advancing body 27A is coupled to the drum by the rods 20 and spacing bolts 22 which extend through the radial slots 31, it can theoretically carry out a rotational movement only in combination with the drum 18. However, since at least one of the projections 36 on the flange 35A is inserted in a radial slot 31 due to the inclination of the advancing member 27A, the advancing member 27A cannot rotate. Rather, the sleeve 24 rotates together with the shaft 7 within the bearings 26, and forces the advancing member 27A to execute an axial wobbling motion, during which its outer section which projects beyond the drum jacket continuously transports the thread windings in an axial direction toward the rim 23 of the drum. The drum, which would follow the rotation of the shaft 7,12,13, is prevented from doing so by the projections 40 on the support 39, which projections engage the radial slots 31. In this manner the drum remains stationary, being held by the advancing member 27A, while the shaft can rotate. Since the thread-feed element 14 and shaft 7 rotate constantly around the axis 33, the point of engagement between the projections 36 and the radial slots 31 or the projections 40 and the radial slots 31 moves with the same rotational speed and constant radial and circumferential offset. Thus a positive connection between the stationary flange 35A and the storage drum 18 is constantly maintained which prevents the drum from rotating.

Figure 1A:
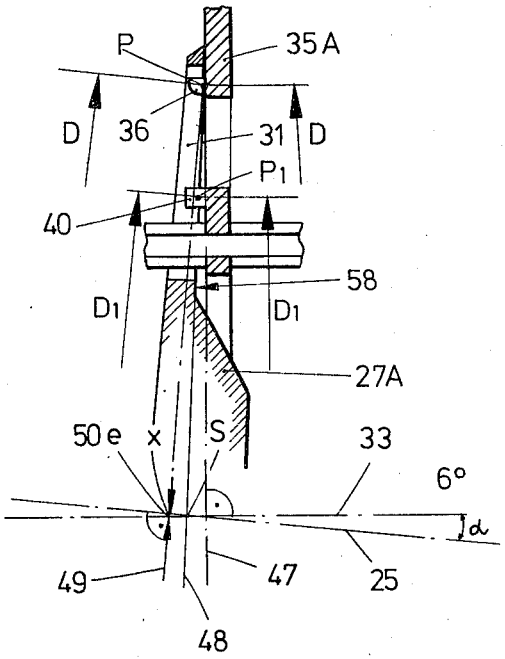
FIG. 1*a* is an enlarged detail of FIG. 1 to more clearly illustrate the geometric relationships.

The following geometrical relationships, which are emphasized hereinafter and in FIG. 1*a*, result in an ideal rolling movement of the advancing member 27A on the flange 35A, and in a particularly careful (i.e., gentle) engagement between the projections 36 and 40 and the slots 31. The momentary point of engagement P between a projection 36 and the slot 31 serves to define three planes 47,48,49. P is thereby located at the point of intersection of the center axis of the projection 36 and the front face 58 of the advancing member 27A, which face is inclined by an angle $\alpha/2$ (for example, 3°) relative to a perpendicular to the axis 25 when the selected inclination of the axis 25 amounts to $\alpha$ (for example, 6°) relative to axis 33. The plane 49 through P is perpendicular to the axis 25 and intersects same at point X. The plane 47 is perpendicular to the axis 33. The bisector plane 48 passes through the common point of intersection S of the axes 33 and 25 and also contains therein the face 58. In this arrangement, the point X has a radial leverage 50 (equal to distance "e") about the axis 33, that is, point X carries out a rotational or orbital movement about the axis 33 when the shaft 7 rotates. This leverage 50 results in particularly gentle engagement. The magnitude of the leverage 50 is found by the above-discussed construction. The positive effect of the geometrical relationships is that, in spite of the inclination of the axis 25, both of the locations of engagement between the projections 36 and the slots 31 and also between the projections 40 and the slots 31 are located on the same diameter D or $D_1$ of the advancing member and of the device itself, respectively, relative to each axis 25 or 33. That is, the radial distance as measured on the advancing member 27A from point P to its axis 25 at point X, is equal to the radial distance on the drum or frame as measured from point P (within plane 47) to its axis 33. This is of importance during manufacture.

Figure 2:
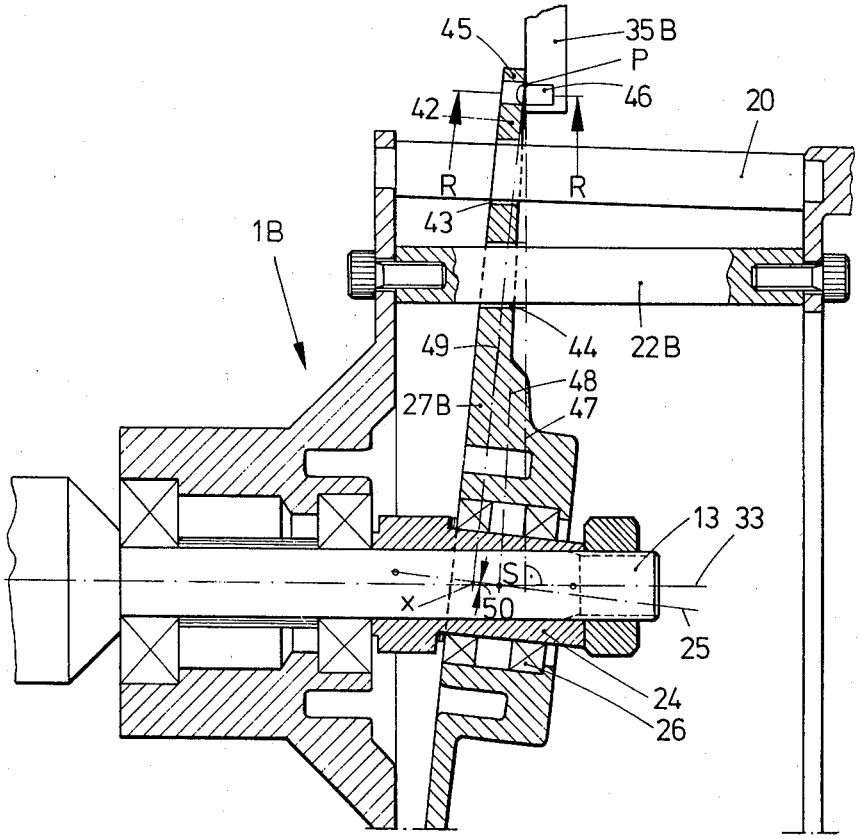
FIG. 2 illustrates a portion of a longitudinal cross section of a further embodiment of such a device.

FIG. 2 illustrates a portion of a further embodiment of a device 1B, in which the advancing member 27B as mounted on the journal 13 is of a different design. It is constructed with a disk-shaped outer section 42 which projects beyond and surrounds the drum jacket formed by the rod cage 20, and has openings 43 and 44 through which extend the rods 20 of the spacing bolts 22B. In this manner a positive coupling between the advancing member 27B and the drum is achieved through the openings 43 or 44. Near its outer rim, the outer section 42 of the advancing member 27B has depressions or holes 45 (counterbraking elements) which are uniformly distributed over the periphery, and associated therewith are axial projections or pegs 46 (braking elements) which are mounted on the flange 35B and which come into progressive engagement with the holes.

To achieve a perfect rolling movement of the outer rim 42 of the advancing member 27B on the side surface of the flange 35B, and to prevent any rotational movement of the storage drum which may be produced by the rolling movement on the wobbling advancing member 27B, the geometrical conditions explained above with reference to FIG. 1*a* must be met. The point of engagement P between a projection 46 and a recess 45 is again employed to define the imaginary planes 47,48,49 which results in the intersection point X between the plane 49 and the axis of rotation 25 in order to establish the radial leverage 50 of the point X with respect to the axis of rotation 33. The magnitude of the leverage 50 is so great that the radius R, at which the recesses 45 are arranged with respect to the axis of rotation 25, equals the radius R at which the projections 46 are positioned relative to the axis of rotation 33. The result is that, during rotation of the shaft, there is no resulting rotational movement of the advancing member and thus the storage drum remains stationary. The front face of the advancing member 27B thereby follows, at least in its radially outer region, the angle bisector defined by plane 48.

Figure 3:
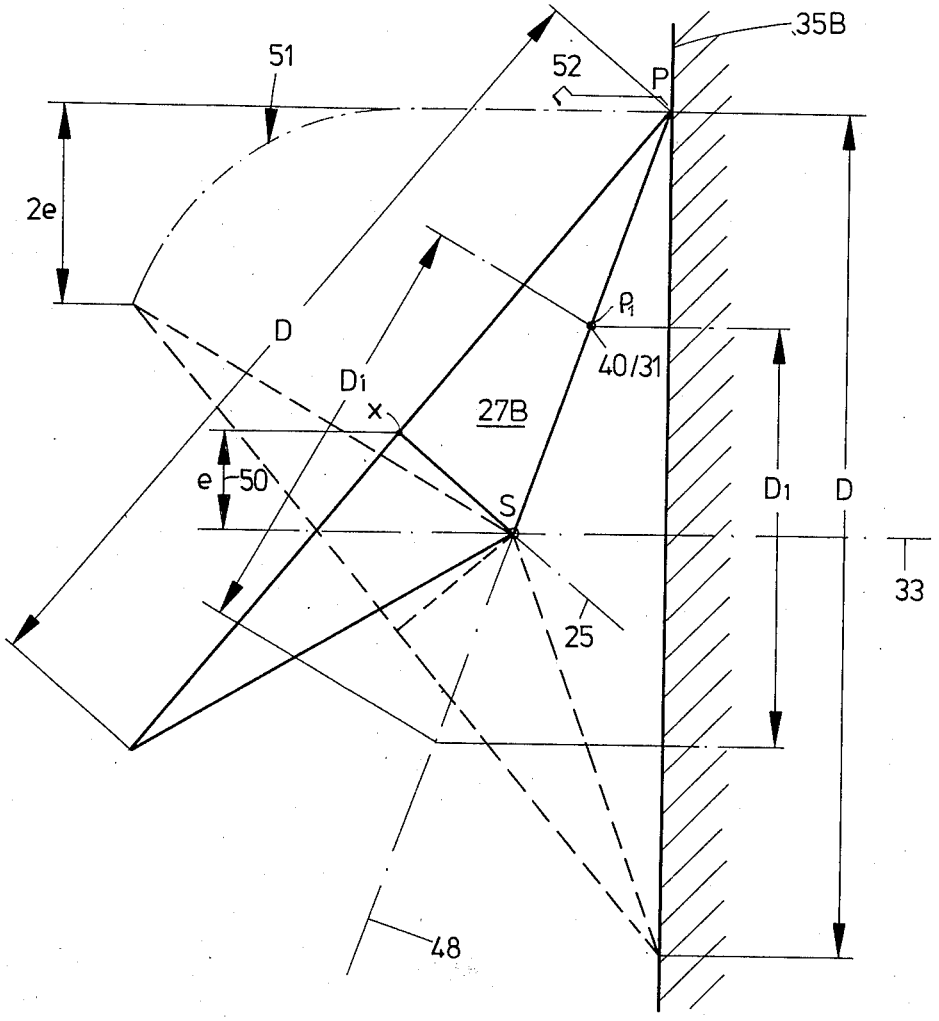

FIGS. 3 and 4 illustrate how a point P on the advancing member 27B, which point coincides with the actual point of engagement between the braking and counterbraking elements (i.e., projections 36 and slots 31), moves or migrates during the axial wobbling movement of the advancing member 27B relative to a stationary viewer and, after a 360° rotation about the axis 33, returns again exactly to the point of engagement P. From the chosen geometrical conditions (see FIG. 2) there results a special curve of movement 51 for each point of the advancing member 27B, which illustrates why the advancing member remains stationary on the flange 35B through the engagement with the counterbraking elements. FIG. 3 illustrates the curve of movement 51 of the point P viewed tangentially with respect to the advancing member circumference. The frontmost area 52 of the curve 51, starting out from the point of engagement P, which is of special importance for holding the drum stationary and for the forward movement of the thread windings, extends linearly. FIG. 4 also illustrates the curve of movement 51 in a view which is rotated 90° with respect to FIG. 3, namely being viewed in a direction extending radially from the point of engagement P toward the axis 33. In the frontmost curve section 52 there exists, as seen from this viewing direction of FIG. 4, a linear movement of the point P of the advancing member 27B. From FIG. 3 we can recognize that, from this viewing direction, the point P carries out during wobbling of the advancing member 27B (but only after the linear section 52) a radial inward movement at twice the amount of the leverage 50 (which equals distance "e"). FIG. 4, however, illustrates from the different viewing direction, that the curve of movement, after the section 52, makes a loop with a width which amounts approximately to 2.6 times the magnitude of the leverage 50, i.e., 2.6 e. Since the braking elements and the counterbraking elements engage only through the area of the wobbling movement which corresponds with the curve section 52, an oscillating movement of the advancing member 27 relative to the drum 18 and relative to the flange 35 does not occur; the engagement between the braking elements occurs particularly gently and exactly during a 360° rotation of the shaft 7, namely in spite of the wobbling or rolling movement of the advancing member 27. Each point P on the advancing member 27B carries out its radial inward movement (FIG. 3, left curve section) and its sideward movement (FIG. 4, loop lying on the left) only when it no longer engages the flange 35B or the counterbraking elements. Rather, the next following point P in the curve section 52 engages a counterbraking element. Thus, relative movements between the engaging braking elements do not exist at the respective point of engagement P. The movement of the thread windings over the axial height of the curve section 52 is also done gently, since the outer section of the advancing member and naturally also the drum do not carry out any relative oscillating movements around the axes 33 or 25. Such a movement would impose a circumferential friction load on the last thread winding, which could not only cause a breakdown in the desired constant thread unwinding tension, but could result in damage in the case of sensitive thread material. One must also consider that the shaft 13 rotates with a high speed, and when the thread storage is increased, considerable friction forces could be produced. Therefore, it is important that the movement, especially of the last thread winding, occurs gently in the axial direction of the drum, where it has the greatest axial spacing from the discharge end of the feed element 14 and is pressed against the already existing thread storage. The linear course of the curve in the section 52 is a direct consequence of the geometric relationships according to FIG. 2, which, moreover, have been drawn exaggerated in FIGS. 3 and 4 for a better understanding of the invention.

Figure 5:
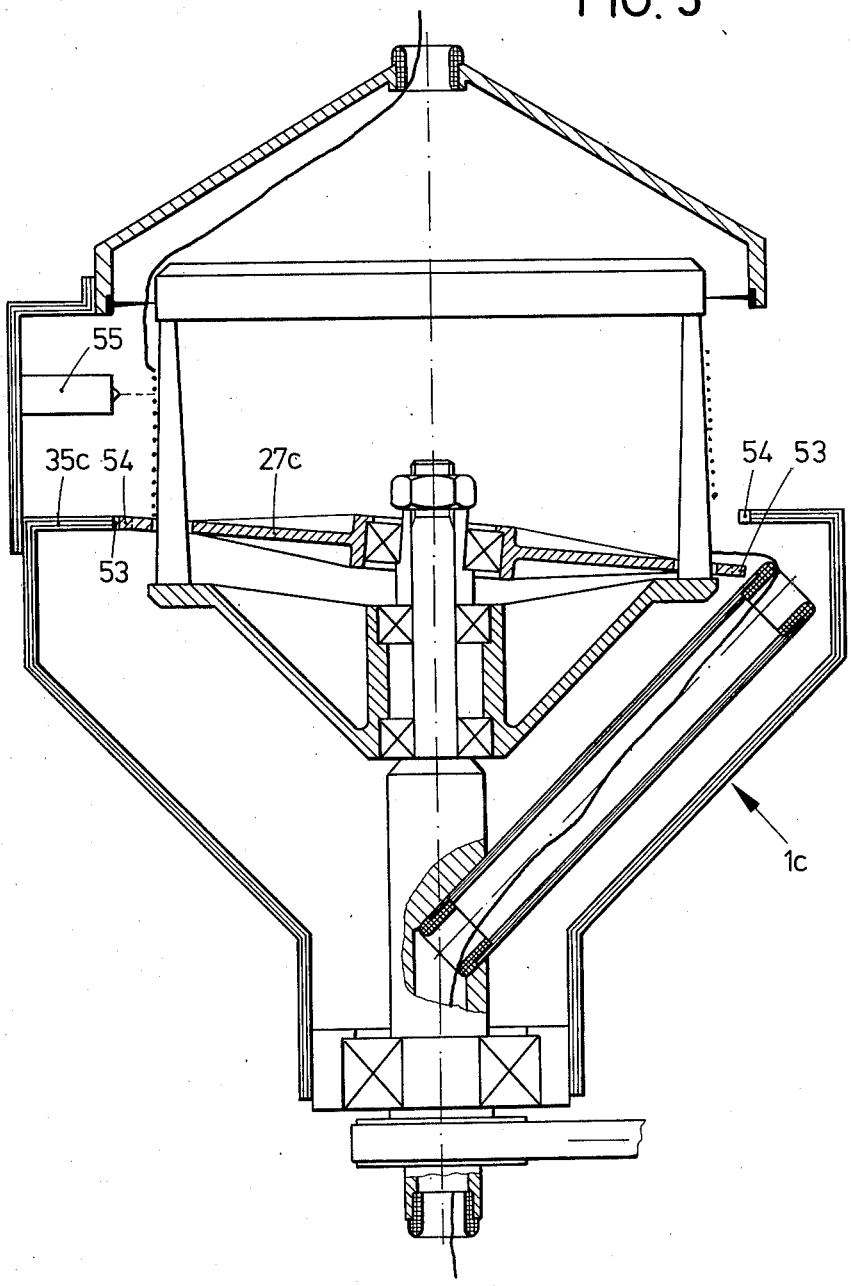
FIG. 5 is a longitudinal cross-sectional view of a third embodiment of a thread-storage and delivery device.
Figure 6:
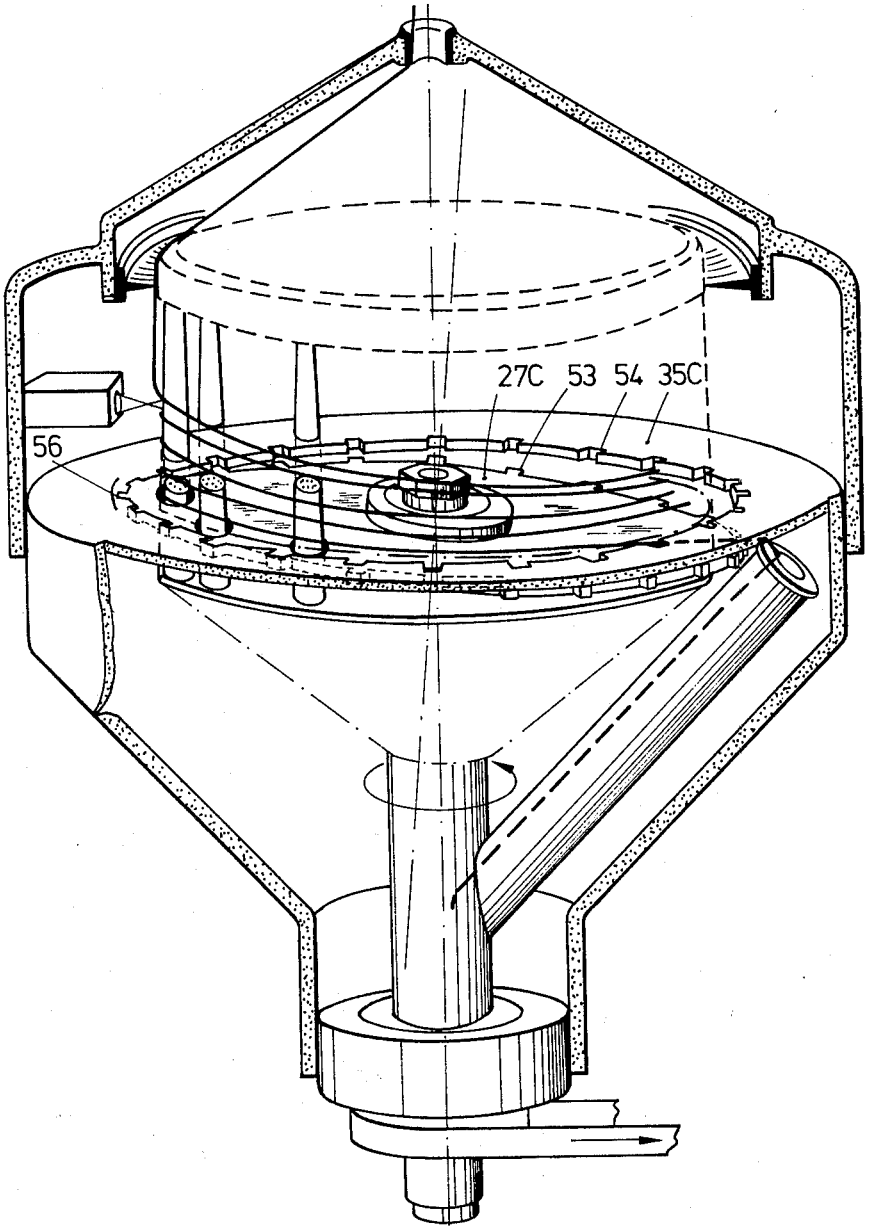
FIG. 6 is a perspective and partially cross-sectional view of the device according to FIG. 5.

FIGS. 5 and 6 illustrate a further exemplary embodiment of a device 1C, wherein FIG. 6 is a perspective and partially sectioned view. The device 1C uses a disk-shaped advancing member 27C whose outer peripheral edge has external teeth 53. The stationary annular flange 35C, which is constructed in one piece with the base member, has internal teeth 54 which progressively mesh with teeth 53 at point 56 as illustrated in FIG. 6, which point is diametrically opposite the discharge end of feed element 14. Numeral 55 identifies a photo-electric thread-storage sensor which detects the thread storage which exists in the form of thread windings on the drum jacket and forwards a switching-on impulse to the motor 11 as soon as the thread storage has dropped below a minimum amount. During the following rotation of the feed element 14, the thread storage is again increased. FIG. 6 illustrates how the thread is introduced into the progressively opening gap between the outer section of the advancing element 27C and the inner toothed circumference of the flange 35C.

FIG. 7 indicates a stationary annular flange 35D of a further modified embodiment, which flange is provided on its side surface with a friction coating 57 of a suitable friction material. An advancing element 27D, which is illustrated schematically as a disk member, carries on its outer section a counterfriction coating 58 which cooperates with the friction coating 57.

FIG. 8 indicates a stationary annular flange 35E and an advancing element 27E. The flange 35E carries, distributed around its periphery, individual magnets 59, with which are associated in the outer section of the advancing member 27E soft iron cores 60. In this manner relative rotation between the advancing member 27E and the flange 35E is prevented, even though these two parts do not need to contact one another.

Due to the high rotational speed of the drive shaft and the corresponding wobbling of the advancing element, special emphasis is placed on low levels of vibration and noise, and it is advantageous if the braking elements and counterbraking elements are made of specially chosen materials. Thus, for example, polyurethane such as Contilan (registered trademark) or comparable plastics have proven to be sufficiently elastic and wear resistant. Also, various material pairs can be used. In particular, the projections 40 on the support according to FIG. 1 can consist of a slightly elastic material; this also applies to the projections 36 of FIG. 1, which can even be made of rubber. The annular flange is advantageously of light metal, in particular aluminum.

It is of no importance for the proper functioning of the device whether it is used vertically, horizontally or obliquely, depending on the purpose of use. The particular advantage lies in the fact that for holding the storage drum stationary, no additional elements or bearings which increase the structural length and complexity are required.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a thread-storage and delivery device for textile machines, comprising a stationary base member, a shaft defining a first axis and rotatably mounted relative to the base member for driving a thread-feed mechanism which includes a feed element for tangentially winding the arriving thread onto the jacket of a storage drum which is supported rotatably on the shaft, from which drum said thread is unwound over the drum rim which does not face the thread-feed side, a thread advancing member which is positively coupled with the storage drum for advancing the thread windings thereon, said advancing member being rotatably supported on the shaft about a second axis which is inclined with respect to the first axis and effects advancement of the thread windings by an outer section which projects beyond the drum jacket and which carries out an axial pivotal wobbling movement during rotation of the shaft about said first axis, and a holding mechanism including cooperating braking and counterbraking elements for securing the storage drum against rotation about the shaft, the improvement wherein one of the braking and the counterbraking elements is provided on a stationary ring-like flange which is structurally connected to the base member and surrounds the storage-drum jacket in radially spaced relation and with an axial spacing relative to the discharge end of the feed element, the other of the braking and the counterbraking elements being provided on the outer section of the thread advancing member, the braking and counterbraking elements engaging one another during rotation of the feed element and during wobbling of the advancing member only at a rotating instantaneous point of engagement (P) which is offset relative to the feed element in the circumferential direction of the drum, the instantaneous point of engagement (P) between the advancing member and the flange being contained in a first plane which is perpendicular to the second axis and intersects said second axis at a point (X) which is radially spaced from the first axis, the instantaneous point of engagement (P) also being contained in a second plane which is perpendicular to said first axis, and said instantaneous point of engagement (P) further being contained in a third plane which bisects the angle between said first and second planes and also contains therein the point of intersection (S) of said first and second axes.

2. A thread-storage and delivery device according to claim 1, wherein the outer section of the advancing member has in its peripheral direction an engagement profile while defines the other of the braking and counterbraking elements, which profile cooperates rotatingly during wobbling of the advancing member with said one of the braking and counterbraking elements as defined by a counterengagement profile on the flange.

3. A thread-storage and delivery device according to claim 2, wherein the advancing member has an outer diameter which exceeds the inner diameter of the flange, wherein the engagement profile comprises depressions in the outer section of the advancing member, and wherein the counterengagement profile comprises projections arranged on the flange projecting approximately parallel with respect to the shaft, which projections during rolling of the advancing member along the underside of the flange progressively enter said depressions.

4. A thread-storage and delivery device according to claim 2, wherein the counterengagement profile comprises an internal toothed structure on said flange, which internal toothed structure engages an external toothed structure which is constructed on the outer section of the advancing member and defines said engagement profile.

5. A thread-storage and delivery device according to one of claims 1 or 2, wherein a friction coating is provided on the flange, in particular on its underside which faces the feed element, and wherein the outer section of the advancing member, which outer section rolls along the underside of the flange, has a corresponding counterfriction surface, said coating and said surface defining said braking and counterbraking elements.

6. A thread-storage and delivery device according to claim 1, wherein the braking elements and counterbraking elements on the advancing member and the ring flange are formed by magnets and soft-iron parts.

7. A thread-storage and delivery device according to claim 3, wherein the depressions in the advancing member are formed by radial slots which extend toward the center of the advancing member.

8. A thread-storage and delivery device according to claim 7, wherein the radial slots are defined on the outer periphery of the advancing member by an annular rim.

9. A thread-storage and delivery device according to claim 7 or claim 8, wherein a circular support with projections thereon which are arranged in correspondence with the distribution of the radial slots in the advancing member is secured inside the storage drum at approximately the same height as the flange, at least one of the projections engaging a radial slot which, at the same time, is also engaged with a projection on the flange.

10. A thread-storage and delivery device according to one of claims 1 to 3, wherein the braking and counterbraking elements consist of a lightweight solid material, preferably an elastic plastic.

11. A thread-storage and delivery device at least according to one of claims 1 to 3, wherein the braking and counterbraking elements are constructed elastically at least parallel with respect to the longitudinal axis and consist of a nonelastic polyurethane plastic.

12. In a thread-storage and delivery device having a stationary frame, a rotatable shaft supported for rotation relative to the frame about its longitudinal axis, a thread-storage drum coaxial with and rotatably supported on said shaft, a thread-feed mechanism connected to said shaft and rotatable therewith for tangentially winding a thread onto the periphery of said storage drum for forming an intermediate thread storage thereon, the thread-feed mechanism including a thread-supply member positioned adjacent the periphery of the drum jacket for guiding the arriving thread tangentially onto the drum periphery, guiding means for causing the thread to be unwound and withdrawn from the drum over a rim thereof which faces away from the thread input feed side, a disklike thread-advancing member positively coupled to the drum for advancing the thread winding thereon axially toward the rim, said thread-advancing member being rotatably supported on said shaft about an axis which is inclined at a small angle relative to the longitudinal shaft axis so that the advancing member executes an axial wobbling movement relative to the drum as the shaft rotates, the advancing member including an outer portion which projects beyond the periphery of the drum and engages the thread windings on the drum for axially displacing said thread windings during said wobbling movement, and stop means for maintaining the storage drum stationary, comprising the improvement wherein the stop means includes coacting braking and counterbraking elements which cooperate directly between the frame and the thread-advancing member, said braking elements being provided on an annular flange which is structurally fixed to said frame and which annularly surrounds the periphery of the storage drum in radially spaced relationship thereto and is also axially spaced from the discharge end of the thread-supply member, the counterbraking elements being provided on the outer portion of the thread-advancing member, the braking and counterbraking elements being disposed in engagement with one another during rotation of the thread-feed mechanism at only a single point which is offset circumferentially of the storage drum relative to the discharge end of the thread-supply member, said point rotatably migrating around the drum in correspondence with the rotation of the thread-feed mechanism.

13. A device according to claim 12, wherein the annular flange surrounds that portion of the storage drum periphery having the thread storage provided thereon, said annular flange being sufficiently radially spaced from the storage drum periphery so as to enable the thread storage to pass axially through the opening defined by the annular flange, said annular flange being positioned axially relative to the drum between the discharge end of the thread-supply member and the withdrawal rim of the drum, and said thread-advancing member being disposed on the side of said annular flange which is axially opposite said withdrawal rim.

14. A device according to claim 13, wherein the point of engagement between the advancing member and the annular flange is disposed relative to said drum substantially diametrically opposite from the discharge end of the thread-supply member, whereby the side of said advancing member which is diametrically opposite said point of engagement is axially spaced a substantial distance from the annular flange to create a substantial gap therebetween, the discharge end of said thread-supply member being axially located in radial alignment with this gap to permit the arriving thread to be tangentially wound around the periphery of the drum.

15. A device according to any one of claims 12–14, wherein the point of engagement between the advancing member and the annular flange is contained in and defines three planes, the first said plane being perpendicular to the axis of said advancing member and intersecting said axis at a point which is radially spaced from the longitudinal shaft axis, a second said plane being perpendicular to said longitudinal shaft axis, and a third said plane substantially bisecting the included angle between said first and second planes and containing therein the point of intersection of said longitudinal shaft axis and said advancing member axis.

16. A device according to claim 12, wherein the braking and counterbraking elements are defined by annular sets of teethlike projections and cooperating recesses.

17. A device according to claim 16, wherein said teethlike projections project substantially axially relative to the drum, and wherein the point of engagement is radially spaced substantially equal distances from both the longitudinal shaft axis and the advancing member axis.

* * * * *

UNITED STATES PATENT AND TRADEMARK OFFICE

CERTIFICATE OF CORRECTION

PATENT NO. : 4 280 668

DATED : July 28, 1981

INVENTOR(S) : Fred Billy Lindstrom

It is certified that error appears in the above—identified patent and that said Letters Patent is hereby corrected as shown below:

Column 9, line 67; change "while" to ---which---.

Signed and Sealed this

*Twentieth* Day of *April 1982*

[SEAL]

*Attest:*

GERALD J. MOSSINGHOFF

*Attesting Officer*

*Commissioner of Patents and Trademarks*